United States Patent [19]

Neukomm

[11] Patent Number: 4,599,864

[45] Date of Patent: Jul. 15, 1986

[54] GAS ENGINE WITH GAS SUPPLY DEVICE

[75] Inventor: Peter Neukomm, Wettingham, Switzerland

[73] Assignee: Pewa Technic AG, Dietikon, Switzerland

[21] Appl. No.: 691,699

[22] Filed: Jan. 15, 1985

[30] Foreign Application Priority Data

Jan. 25, 1984 [CH] Switzerland ..... 315/84

[51] Int. Cl.[4] ..... F01K 25/00

[52] U.S. Cl. ..... 60/671; 60/669

[58] Field of Search ..... 60/641.1, 651, 659, 60/669, 671; 62/50

[56] References Cited

U.S. PATENT DOCUMENTS 4,092,830 6/1978 Rilett ..... 60/671
4,318,274 3/1982 Farrer-Halls ..... 60/669 X

FOREIGN PATENT DOCUMENTS 0009929 3/1980 European Pat. Off. .
2700727 7/1977 Fed. Rep. of Germany .
610031 8/1926 France ..... 60/671
888386 12/1943 France .
2216516 8/1974 France .
2457375 1/1981 France ..... 60/651
2018366 10/1979 United Kingdom .

*Primary Examiner*—Stephen F. Husar
*Attorney, Agent, or Firm*—Werner W. Kleeman

[57] ABSTRACT

A gas engine with a gas supply device contains a substantially bell-shaped aluminum intermediate housing open on one side and provided with fins on the interior and exterior. A cylinder of the gas engine with good thermal conduction properties and a sleeve accommodating a pressurized gas container having good thermal conduction properties are fastened to this intermediate housing. A gas supply conduit leads from the pressurized gas container to the gas engine. A gas superheater conduit structure is in thermal communication with the intermediate housing and situated at the beginning of the gas supply conduit. The thermal unit formed jointly by the intermediate housing, the cylinder, the sleeve surrounding the pressurized gas container and the gas superheater conduit structure permits operation of the gas engine under all practically arising ambient temperatures without damage to the gas engine, since this thermal unit prevents the gas in the gas engine from condensing back to its fluid or even solid state.

7 Claims, 1 Drawing Figure

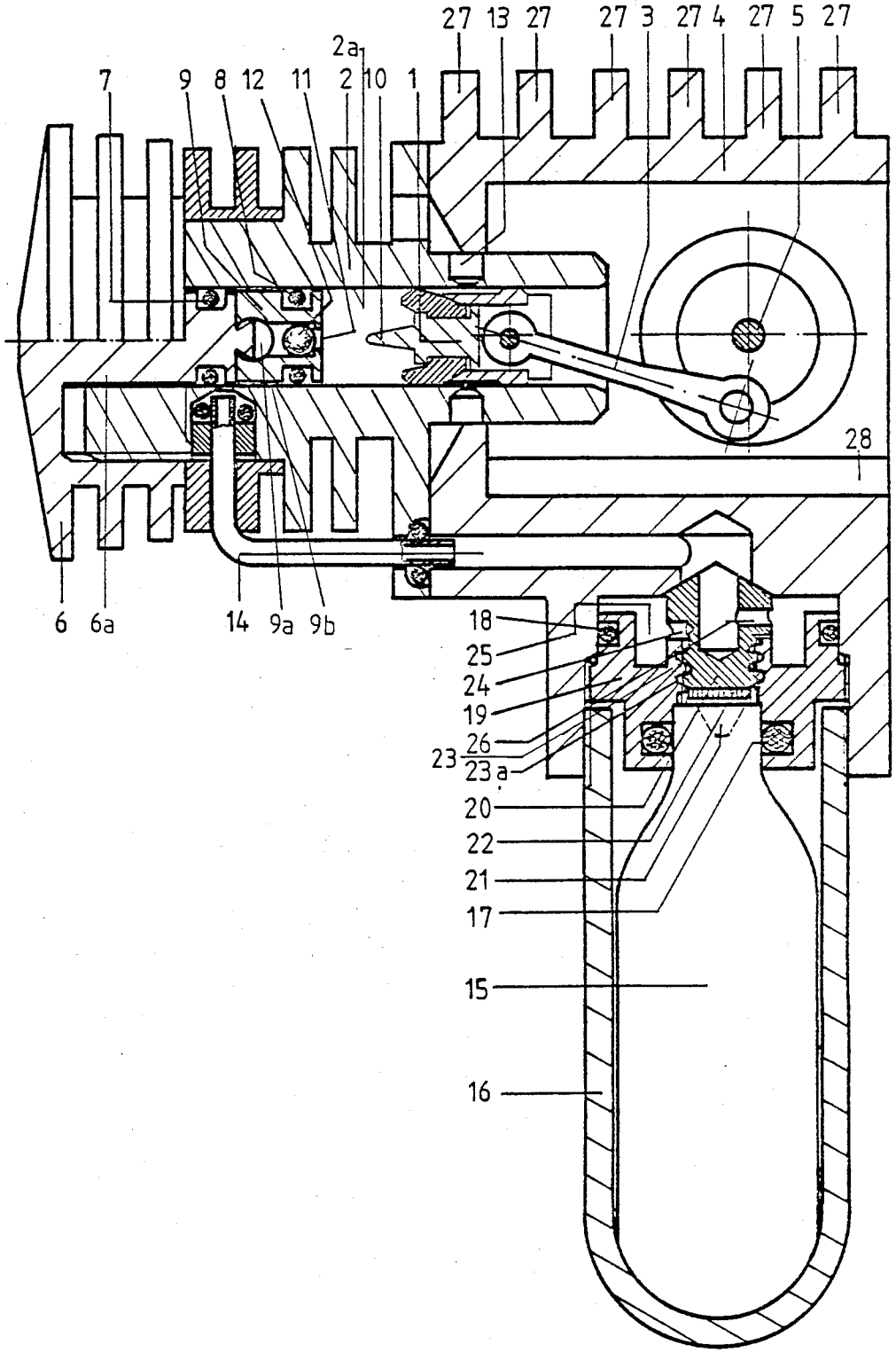
27
13
27
27
3
27
4
27
5
27
2a
7
9
8
12
11
2
10
1
28
6
6a
14
9a
9b
18
25
24
19
26
23
23a
20
22
21
17
15
16

GAS ENGINE WITH GAS SUPPLY DEVICE

CROSS REFERENCE TO A RELATED APPLICATION

This application is related to my presently co-pending, commonly assigned U.S. patent application Ser. No. 691,691, filed 1/15/85, and entitled GAS ENGINE.

BACKGROUND OF THE INVENTION

The present invention broadly relates to gas engines and, more specifically, pertains to a new and improved construction of a gas engine equipped with a gas supply device.

Generally speaking, the gas engine of the present invention is equipped with a gas supply device comprising an intermediate housing at which there is mounted at least one pressurized gas container or reservoir accommodated in a sleeve and containing at least partially liquid gas. At the intermediate housing there is also mounted at least one gas engine. A gas superheater conduit structure is arranged within the extent of a gas supply conduit leading from the pressurized gas container to the gas engine.

In other words, the gas engine of the present invention is of the type having a gas supply device and comprising an intermediate housing, at least one sleeve mounted at the intermediate housing, at least one pressurized gas container for containing partially liquid gas and accommodated within the sleeve and mounted at the intermediate housing by means of the sleeve, at least one gas engine mounted at the intermediate housing, a gas supply conduit leading from the pressurized gas container to the gas engine and having a predetermined extent, and a gas superheater conduit structure or means arranged within the extent of the gas supply conduit.

A gas engine having a gas supply device of the initially mentioned type is known from the German Patent Publication No. 2,700,727, published July 21, 1977. In the arrangement disclosed in this publication, the pressurized gas container or reservoir is thermally separate from the gas engine and the gas superheater conduit and is surrounded by a latent heat-storage substance. This latent heat-storage substance must be heated sufficiently far above its own freezing or crystallization temperature before beginning operation. Otherwise the latent heat-storage substance is ineffective. The thermal conductivity of the latent heat-storage substance is very low, especially in the solid state. This substance can therefore only be applied in relatively thin layers, e.g. 0.5 mm. The heat extraction and heat absorption times must be designed sufficiently long, for instance for a matter of minutes. The gas superheater conduit thermally separated from the pressurized gas container and its surrounding latent heat-storage substance are heated either by a second heat-storage substance having a higher melting or crystallization temperature than the first or by a finned metallic component exposed to ambient air and having good thermal conduction properties.

In the first case, the heat-storage substance surrounding the gas superheater conduit must be brought to a higher temperature than the heat-storage substance surrounding the pressurized gas container. In practical operation this leads to several difficulties, especially when the ambient temperature lies in the region of the melting or crystallization temperature of the second heat-storage substance or below it. When the second heat-storage substance remains ineffective due to insufficient heating, the unsuperheated saturated gas can condense back to its liquid or solid state in the engine and cause mechanical damage.

In the second case, the temperature around the gas superheater conduit will attain at most the ambient temperature. At low ambient temperatures, the temperature of the gas superheater conduit can still be insufficiently greater than the temperature in the pressurized gas container determined by the heat-storage substance surrounding it, so that the gas can still condense back to its liquid or solid state in the engine and cause mechanical damage.

Furthermore, commercially available heat-storage substances have a relatively short service life since their latent heat-storage capacity diminishes after a few hundred state changes. This known gas engine and its associated gas supply device also comprise a multiplicity of components and are therefore relatively expensive and complicated.

SUMMARY OF THE INVENTION

Therefore, with the foregoing in mind, it is a primary object of the present invention to provide a new and improved construction of a gas engine having a gas supply device which does not exhibit the aforementioned drawbacks and shortcomings of the prior art constructions.

Another and more specific object of the present invention aims at providing a new and improved construction of a gas engine of the previously mentioned type which can be operated without mechanical damage under all practically arising ambient temperatures, which is simply constructed and which can be uniformly heated up within a relatively short time interval by ambient heat, especially after an interruption of operation.

A further significant object of the present invention aims at providing a new and improved construction of a gas engine of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the gas engine of the present invention is manifested by the features that the intermediate housing is made of a material with a relatively high specific heat and possesses a substantially bell shape open at one side and provided with fins on at least one of its internal and external surfaces and that the intermediate housing, the gas superheater conduit structure, the sleeve having good thermal conduction properties and in thermal communication with the pressurized gas container as well as a thermally conductive cylinder surrounding at least the operating chamber of the gas engine are in mutual thermal communication.

In other words, the gas engine of the present invention is manifested by the features that the intermediate housing comprises a material having a relatively high specific heat and a substantially bell-shaped configuration with at least one open side. The substantially bell-shaped intermediate housing has an internal surface and and external surface and is provided with fins on at least one of these two surfaces. The sleeve has good thermal conduction properties and is in thermal communication with the pressurized gas container. The gas engine has an expansion chamber and a thermally conductive cylinder surrounds at least the expansion chamber of the gas engine. The internal housing, the gas superheater conduit structure, the sleeve and the thermally conductive cylinder are in mutual thermal communication.

The intermediate housing is advantageously made of aluminum. The mass of the intermediate housing is preferably seven times greater than the mass of the gas storable in the pressurized container.

In an advantageous embodiment, the surface of the intermediate housing capable of being swept by air is at least twenty square centimeters per gram of gas storable in the pressurized gas container.

The gas superheater conduit structure or means can comprise a helical shape formed by blunting the crests of a screw thread which is in thermal communication with the intermediate housing. A liquid separator chamber can be arranged between the gas superheater conduit and the gas engine for effecting a reversal of direction of the gas flow.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE schematically illustrates a gas engine with a gas supply device in cross-section.

DETAILED DESCRIPTION OF THE PREFERRED EMBODIMENTS

Describing now the drawing, it is to be understood that to simplify the showing thereof only enough of the structure of the gas engine has been illustrated therein as is needed to enable one skilled in the art to readily understand the underlying principles and concepts of this invention. Turning now specifically to the drawing, the apparatus illustrated therein by way of example and not limitation will be seen to comprise a piston 1 reciprocatingly guided in a cylinder 2 and connected by a connecting rod 3 to a crankshaft 5 journalled in an intermediate housing 4. The cylinder 2 is made of a material having good thermal conduction properties and is fastened to the intermediate housing 4. The crankshaft 5 can drive the wheels of for instance, a model car through a not particularly shown transmission or for instance, can directly drive the propeller of a model aircraft. The employment of this gas engine is, however, not limited to models and toys.

A cylinder head 6 is threaded onto an extension of the cylinder 2 and a portion **6*a* thereof protrudes into a bore of the cylinder 2. The protruding portion 6*a* of the cylinder head 6, is sealed to the bore 2*a* of the cylinder 2 by an O-ring 7. The protruding portion 6*a* of the cylinder head 6 supports or engages a gas inlet valve 9 seated in the bore 2*a* of the cylinder 2 and sealed to the bore 2*a* by an O-ring 8. A cross channel 9*a* of the gas inlet valve communicates with a substantially annular void or interstice 9*b* formed between the bore 2*a* of the cylinder 2 and the body of the gas inlet valve 9. The closure of the gas inlet valve 9 is formed by a ball 12 which can be pushed into an open position of the gas inlet valve 9 within a gas inlet aperture or opening 11 by a protrusion 10 formed on the upper or operating surface of the piston 1. By screwing the cylinder head 6 in and out, the gas inlet valve 9 can be shifted in position within the bore 2*a* of the cylinder 2 to regulate timing of valve opening and therefore the rotational speed of the gas engine. The gas expanded in the expansion chamber formed by the cylinder 2 and the piston 1 escapes through the exhaust aperture or port 13 when the piston 1** is in its lowest position, the so-called bottom dead-center position.

A gas supply device is connected to the inlet side of the gas inlet valve 9 through the interstitial void **9*b* between the cylinder bore 2*a* and the body of the gas inlet valve 9 and through the cross channel 9*a* by a gas supply conduit 14. The operative gas, which may be carbon dioxide or nitrous oxide, is stored in a pressurized gas container or reservoir 15 partially in liquid form. The pressurized gas container or reservoir 15, in this illustrative embodiment, is a commercially available carbon dioxide cartridge and is accommodated in a sleeve 16 screwed to the intermediate housing 4 and made of a material having good thermal conduction properties. A good thermal connection or communication is provided between the sleeve 16 and the pressurized gas container or reservoir 15**.

A nozzle retainer or intermediate member 19 is threaded into the intermediate housing 4 at the connection location of the pressurized gas container or reservoir 15. This nozzle retainer 19 is provided with two O-rings 17 and 18 and is made of a material having good thermal conduction properties. The O-ring 17 seals the neck or throat of the pressurized gas container or reservoir 15 in the nozzle retainer 19 and the O-ring 18 seals the nozzle retainer 19 in the intermediate housing 4. A nozzle member 20 is threaded into the nozzle retainer 19. The nozzle member 20 comprises an opening or puncturing pin 21 at its forward end for puncturing the seal of the carbon dioxide cartridge and permitting gases to exit from the cartridge. The nozzle member 20 also comprises a zone subsequent to the opening pin 21 provided with fine longitudinal grooves 22 at its periphery and serving for filtering the gas. The screw thread, and specifically the crests of the threads, are blunted both on the nozzle member 20 and in the nozzle retainer 19. As a result there are formed dual helical conduits **23*a* which serve as a gas superheater conduit structure 23 and these two helical conduits 23*a* are in good thermal communication with the intermediate housing 4. The gas exits from the gas superheater conduit structure 23 through a bore 24 into a liquid separator chamber 25. The fluid or gas is constrained to change direction in the liquid separator chamber 25 and exits through a bore 26. The gas supply channel 14 is free from the bore 26 up to the inlet side of the gas inlet valve 9**.

The intermediate housing 4 is made of a material having a relatively high specific heat, advantageously aluminum or an aluminum alloy suitable for injection molding, in order that as much heat as possible can be stored in the intermediate housing 4. The sensible heat thus stored is necessary for heating the gas superheater conduit structure 23 and the cylinder 2, especially during brief high performance demands on the engine. The form of the intermediate housing 4 is designed to permit ambient air to sweep as great a surface as possible. The intermediate housing 4, in addition to the cylinder 2 and the sleeve 16, must be able to absorb as much heat as possible from the ambient air in as short a time as possible. The intermediate housing 4 therefore has a substantially bell-shape which is open at one side or end and is provided with ribs or fins 27 and 28 on its inner and outer surfaces.

In normal operation, equilibrium prevails between the heat requirements of the gas engine and of the gas supply device and the sensible heat absorbed from the ambient air and the stored sensible heat during the entire period of operation. This equilibrium is ensured under all practically arising ambient temperatures which normally lie above the freezing point of water. At low temperatures, reduced performance is still available, while mechanical damage to the gas engine is prevented by the thermal coupling between the pressurized container or reservoir 15, the gas superheater conduit or channel structure 23, the cylinder 2 and the intermediate housing 4.

While there are shown and described present preferred embodiments of the invention, it is to be distinctly understood that the invention is not limited thereto, but may be otherwise variously embodied and practiced within the scope of the following claims.

Accordingly, what we claim is:

1. A gas engine having a gas supply device, comprising:

an intermediate housing;

at least one sleeve mounted at said intermediate housing;

at least one pressurized gas container for containing partially liquid gas and accommodated within said at least one sleeve and mounted at said intermediate housing by means of said at least one sleeve;

at least one gas engine mounted at said intermediate housing;

a gas supply conduit leading from said at least one pressurized gas container to said at least one gas engine and having a predetermined extent;

a gas superheater conduit means arranged within said extent of said gas supply conduit;

said intermediate housing comprising a material having a relatively high specific heat;

said intermediate housing having a substantially bell-shaped configuration with at least one open end;

said substantially bell-shaped intermediate housing having an internal surface and an external surface and being provided with fins on at least one of said internal surface and said external surface;

said at least one sleeve having good thermal conduction properties;

said at least one sleeve being in thermal communication with said at least one pressurized gas container;

said at least one gas engine having an expansion chamber;

a thermally conductive cylinder surrounding at least said expansion chamber of said at least one gas engine; and said intermediate housing, said gas superheater conduit means, said at least one sleeve and said thermally conductive cylinder being in mutual thermal communication.

2. The gas engine as defined in claim 1, wherein:

said material of said intermediate housing having a relatively high specific heat is aluminum.

3. The gas engine as defined in claim 1, wherein:

said intermediate housing has a predetermined mass;

said pressurized gas container storing a predetermined mass of gas; and said predetermined mass of said intermediate housing being at least seven times as great as said predetermined mass of storable gas.

4. The gas engine as defined in claim 3, wherein:

each said internal surface and said external surface having a respective exposed surface;

at least one of said exposed surfaces of said internal surface and said external surface being capable of being swept by ambient air; and said at least one exposed surface possessing a surface area of at least twenty square centimeters for each gram of said predetermined mass of storable gas.

5. The gas engine as defined in claim 1, further including:

a nozzle retainer element in thermal communication with said intermediate housing and provided with a screw thread; and said gas superheater conduit means comprising a helical configuration formed by blunting the crests of said screw thread.

6. The gas engine as defined in claim 1, further including:

a nozzle retainer element in thermal communication with said intermediate housing and provided with a male screw thread;

said intermediate housing being provided with a female screw thread for engaging said male screw thread; and said gas superheater conduit means comprising a double helical configuration formed by blunting the crest of said male screw thread and the crests of said female screw thread.

7. The gas engine as defined in claim 1, further including:

a liquid separator chamber arranged between said gas superheater conduit means and said at least one gas engine for effecting a reversal of direction of gas flow.

* * * * *